US006480116B1

(12) United States Patent
Wang

(10) Patent No.: US 6,480,116 B1
(45) Date of Patent: Nov. 12, 2002

(54) METHOD AND APPARATUS FOR SHOWING SPECIAL CHARACTERS OR FIGURES ON A ROTATING DISK

(75) Inventor: Kuo-Chang Wang, Hsin-Chu (TW)

(73) Assignee: Trojan Technology, Inc., Hsin-Chu (TW)

( * ) Notice: Subject to any disclaimer, the term of this patent is extended or adjusted under 35 U.S.C. 154(b) by 0 days.

(21) Appl. No.: 09/888,489

(22) Filed: Jun. 26, 2001

(51) Int. Cl.[7] ..... G08B 5/36

(52) U.S. Cl. ..... 340/815.53; 340/815.62; 340/815.64

(58) Field of Search ..... 340/815.42, 815.44, 340/815.47, 815.49, 815.53, 815.6, 815.62, 815.64; 368/71, 80, 223

(56) References Cited

U.S. PATENT DOCUMENTS 4,006,476 A * 2/1977 Roomney ..... 340/815.62
4,197,527 A * 4/1980 Romney ..... 340/815.53
4,279,031 A * 7/1981 Dostoomian ..... 340/815.42
5,202,858 A * 4/1993 Kanzaki ..... 368/71
5,682,529 A * 10/1997 Hendry et al. ..... 395/653

* cited by examiner

*Primary Examiner*—Van Trieu
(74) *Attorney, Agent, or Firm*—Bacon & Thomas, PLLC

(57) ABSTRACT

The present invention is a method and apparatus for showing special characters or figures on a rotating disk. A sensor (e.g. spectrum sensor, metal sensor, magnetic field sensor, mechanical contact sensor and sound sensor) and a plurality of light fittings (e.g. bulbs, light-emitting diodes) are fitted to the rotating disk. The sensor detects the surroundings with inconsistency so that different sensed signals at different points are created when the sensor turns around the central axis once. By deciding the fixing points of the repetitive signals, the rotational cycle of the rotating disk is obtained. After analyzing the rotational cycle, different light fittings on the rotating disk light up at different delay time point. In cooperation with the persistency of vision of human eyes, the preset complicate figures and characters are therefore shown on the displaying surface of the rotating disk when it rotates.

7 Claims, 5 Drawing Sheets

METHOD AND APPARATUS FOR SHOWING SPECIAL CHARACTERS OR FIGURES ON A ROTATING DISK

BACKGROUND OF THE INVENTION

1. Field of the Invention

The present invention relates to a method and apparatus for showing special characters or figures on a rotating disk, and more particularly, to a method and apparatus for showing different characters or asymmetric figures on a rotating disk in accordance with different rotational speed thereof.

2. Description of the Prior Art

In the conventional method and apparatus for showing figures on a rotating disk, a row of radial light fittings (e.g. bulbs, light-emitting diodes, etc.) are disposed on the rotating disk. In addition, a simple circuit is provided for driving the light fittings. When the rotational speed is up to a preset value, the light fittings will be driven to intermittently light up in different cycles. When the rotating disk turns, a plurality of light points produced by different light fittings are distributed on the rotating disk, thereby causing figures by means of the persistence of vision.

However, only a microprocessor of the aforementioned method and apparatus is used to control the lighting duration and cycle of each of the light fittings. Therefore, the figures shown on the rotating disk are simple and symmetric (e.g. spoke-shaped, starlike, polygonal, etc.). When the rotational speed is within the tolerance zone, the shown figures are still all right. However, when it goes beyond the tolerance zone, the expected figures will be deformed. Thus, the conventional method and apparatus disk is applicable in limited situations and shows the figure indistinctly.

SUMMARY OF THE INVENTION

It is a primary object according to the present invention to eliminate the aforementioned drawbacks and to provide a method and apparatus for showing special characters or figures on a rotating disk. A sensor is fitted to the rotating disk. The sensor detects the surroundings with inconsistency so that different sensed signals at different points are created when the sensor turns around the central axis once. By deciding the fixing points of the repetitive signals, the rotational cycle of the rotating disk is obtained. After analyzing the rotational cycle, different light fittings on the rotating disk light up at different delay time point. In cooperation with, the persistency of vision of human eyes, the preset complicate figures and characters are therefore shown on the displaying surface of the rotating disk when it rotates.

It is another object according to the present invention to provide a method and apparatus for showing special characters or figures on a rotating disk. A plurality of light fittings (e.g. bulbs, light-emitting diodes, etc.) and a sensor are arranged on the rotating disk. In addition, a circuit is provided for analyzing the surroundings signals detected by the sensor in order to decide the rotational cycle. Meanwhile, the light fittings are driven to intermittently light up at different delay time. When the rotating disk turns, a plurality of light points produced by different light fittings are distributed on the rotating disk, thereby causing figures by means of the persistence of vision of human eyes.

It is a further object according to the present invention to provide a method and apparatus for showing special characters or figures on a rotating disk on which the light fittings are distributed in a nonlinear way on the displaying surface of the rotating disk. In addition, the clearance between the light fittings and the hinge can be different so that a denser scanning route of the light fittings on the displaying surface of the rotating disk is created for a clearer displaying effect.

It is another object according to the present invention to provide a method and apparatus for showing special characters or figures on a rotating disk on which the sensor can be constructed as infrared sensor, spectrum sensor of long and short waves, metal sensor, magnetic field sensor, mechanical contact sensor and sound sensor. Therefore, the present invention has a wider application scope for the convenient design.

BRIEF DESCRIPTION OF THE DRAWINGS

The drawings disclose illustrative an embodiment of the present invention which serves to exemplify the various advantages and objects hereof, and are as follows.

DETAILED DESCRIPTION OF THE PREFERRED EMBODIMENT

Figure 1:
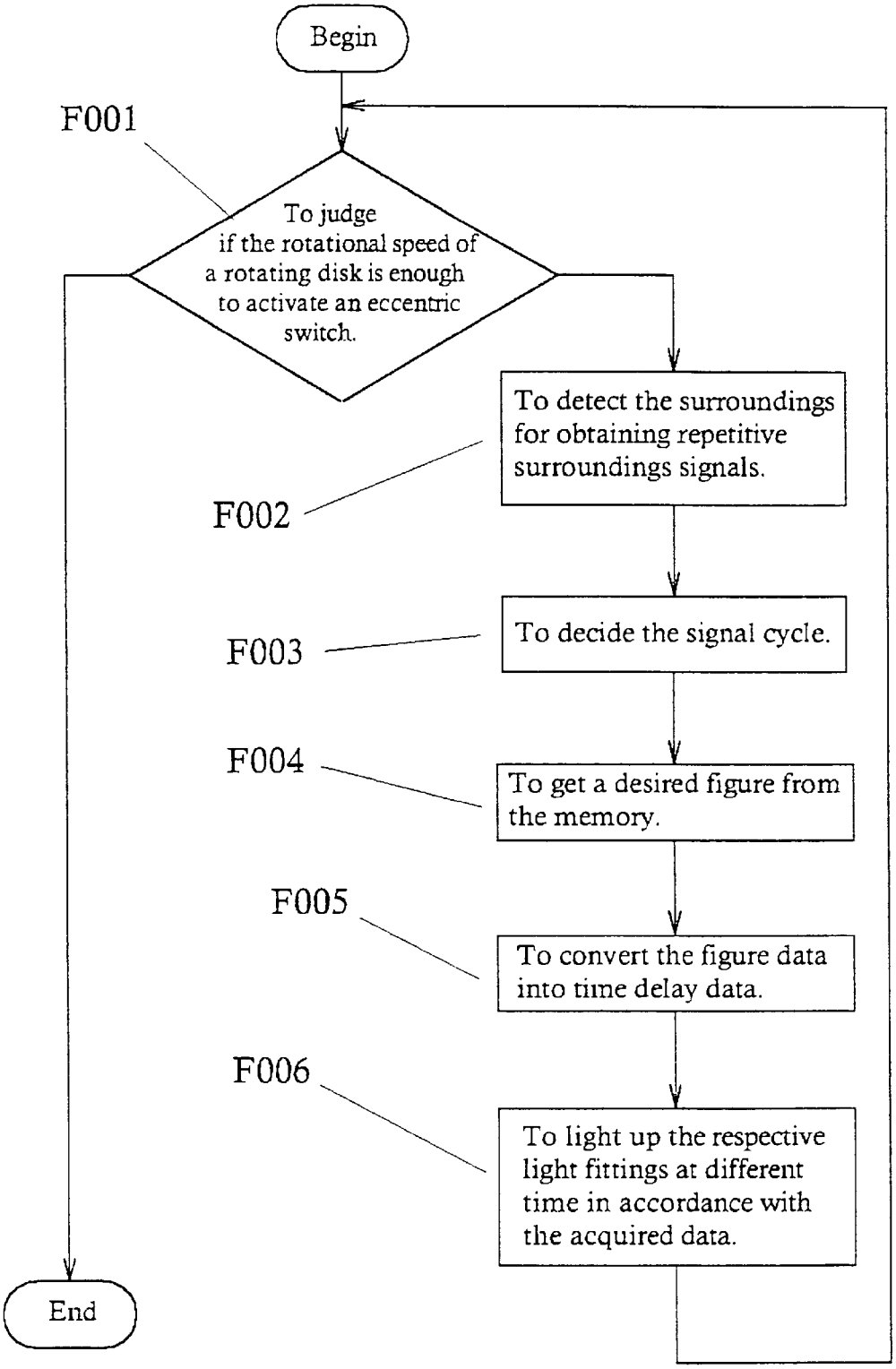
FIG. 1 is a flow chart of the operation of the present invention.

FIG. 1 shows a flow chart of the operation of the present invention. It's apparent that the first step of the whole operation is to judge if the rotational speed of a rotating disk is enough to activate an eccentric switch (Step F001) and if the rotating disk reaches the basic rotational speed (when the rotational speed is too low, the showing of figures or characters will fail). If the answer is "no", a drive circuit doesn't work or stop. If yes, the drive circuit works to detect the surroundings for obtaining repetitive surroundings signals (Step F002). The external surroundings has the characteristic of inconsistency, and a sensor rotating along with the rotating disk detects different surroundings signals at different positions of the circumference while the sensor continues to turn so that the repetitive surroundings signals are obtained. To decide the signal cycle (Step F003) is used to obtain a reference point of the repetitive surroundings for accurately deciding the cycle of the surroundings signals. Thereafter, to get a desired figure from the memory (Step F004) and to convert the figure data into time delay data (Step F005) can produce data of the required lighting duration and interval for each of the light fittings. At last, to light up the respective light fittings at different time in accordance with the acquired data (Step F006) will enable each of the light fittings to light up at different positions of the rotating disk at different time points. By means of the persistence of vision of human eyes, the displaying surface of the rotating disk will create different preset figures or characters.

Figure 2:
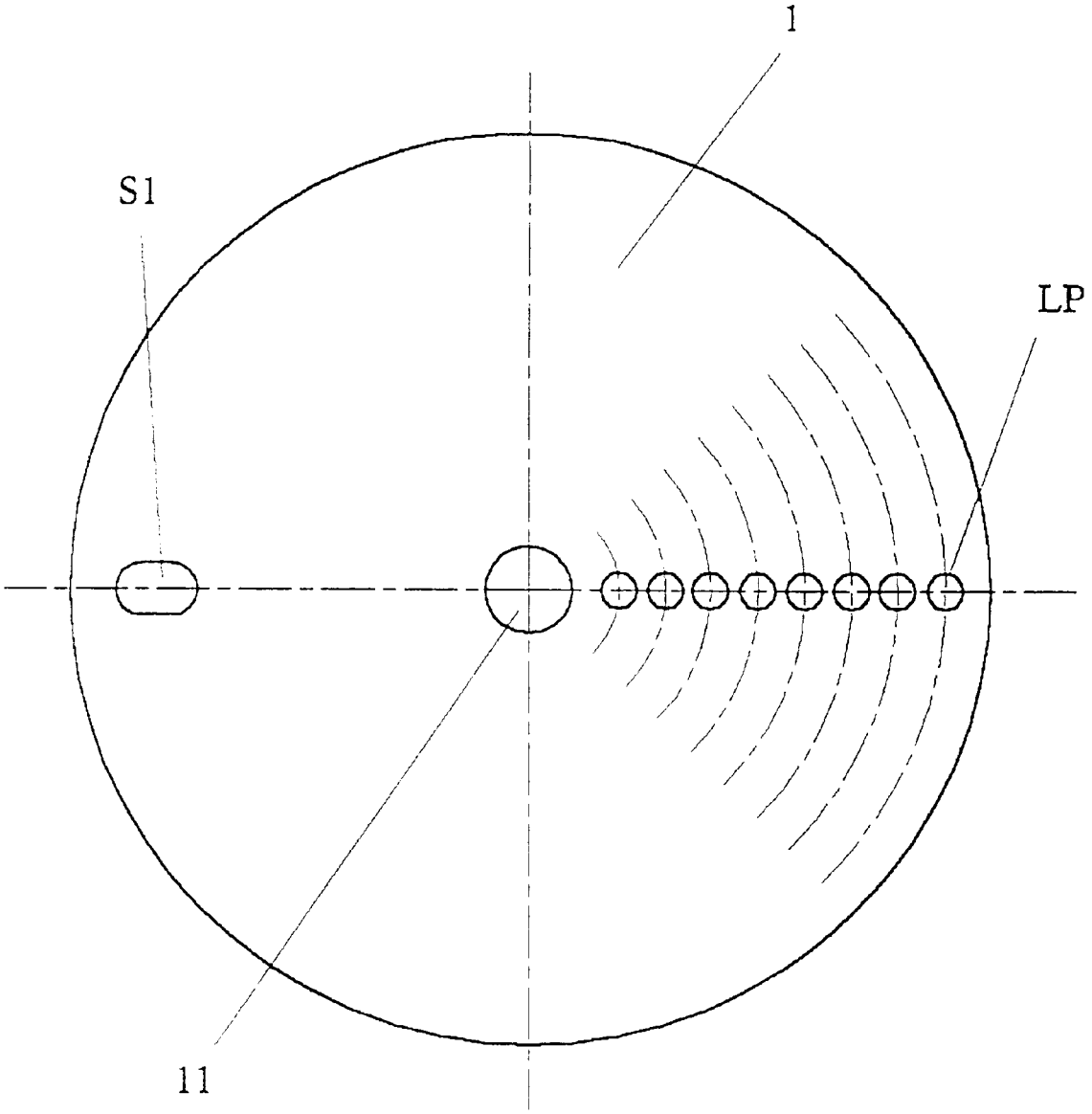
FIG. 2 is a schematic drawing of the rotating disk of the present invention.
Figure 3:
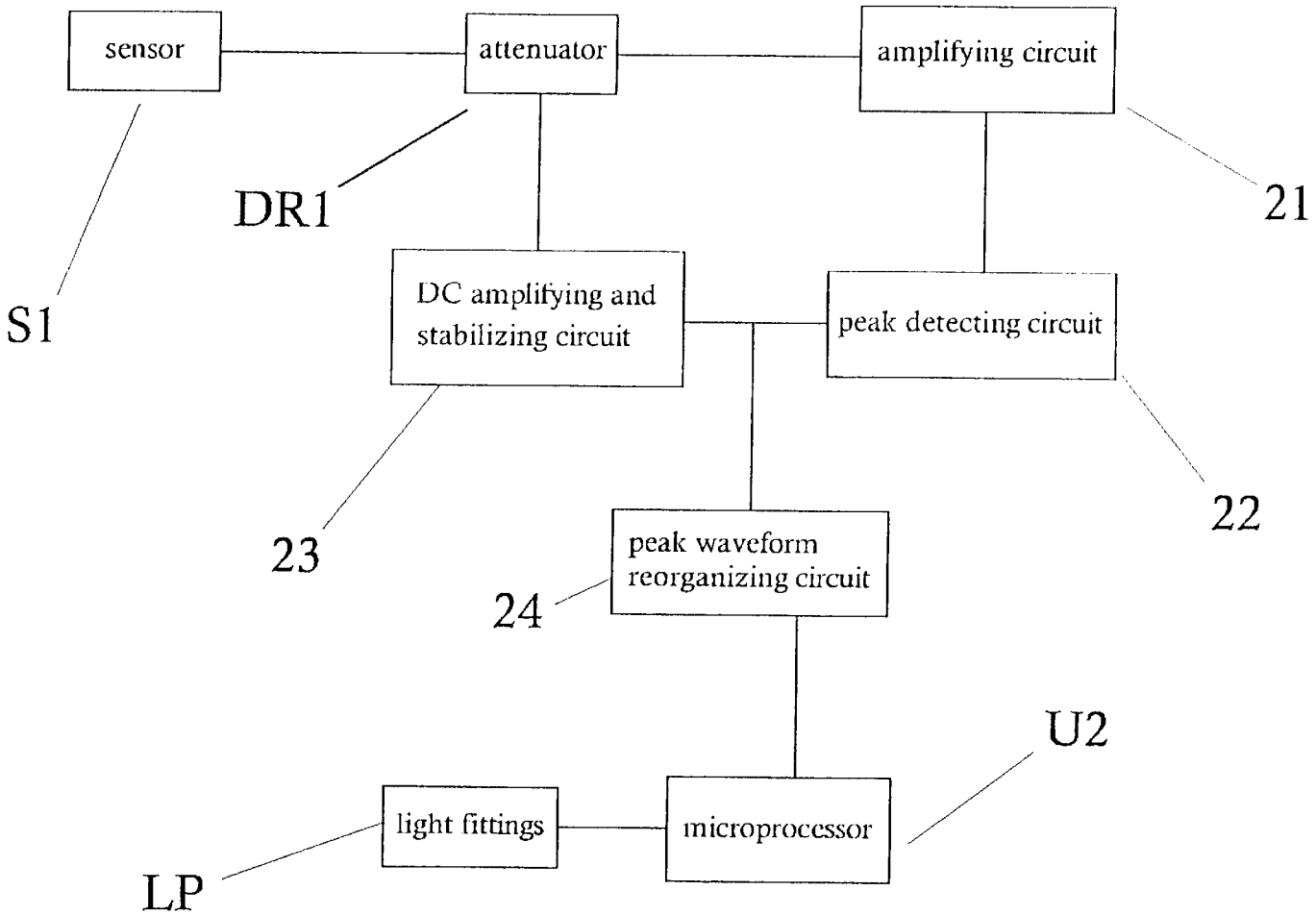
FIG. 3 is a block diagram of the circuit of the present invention.
Figure 4:
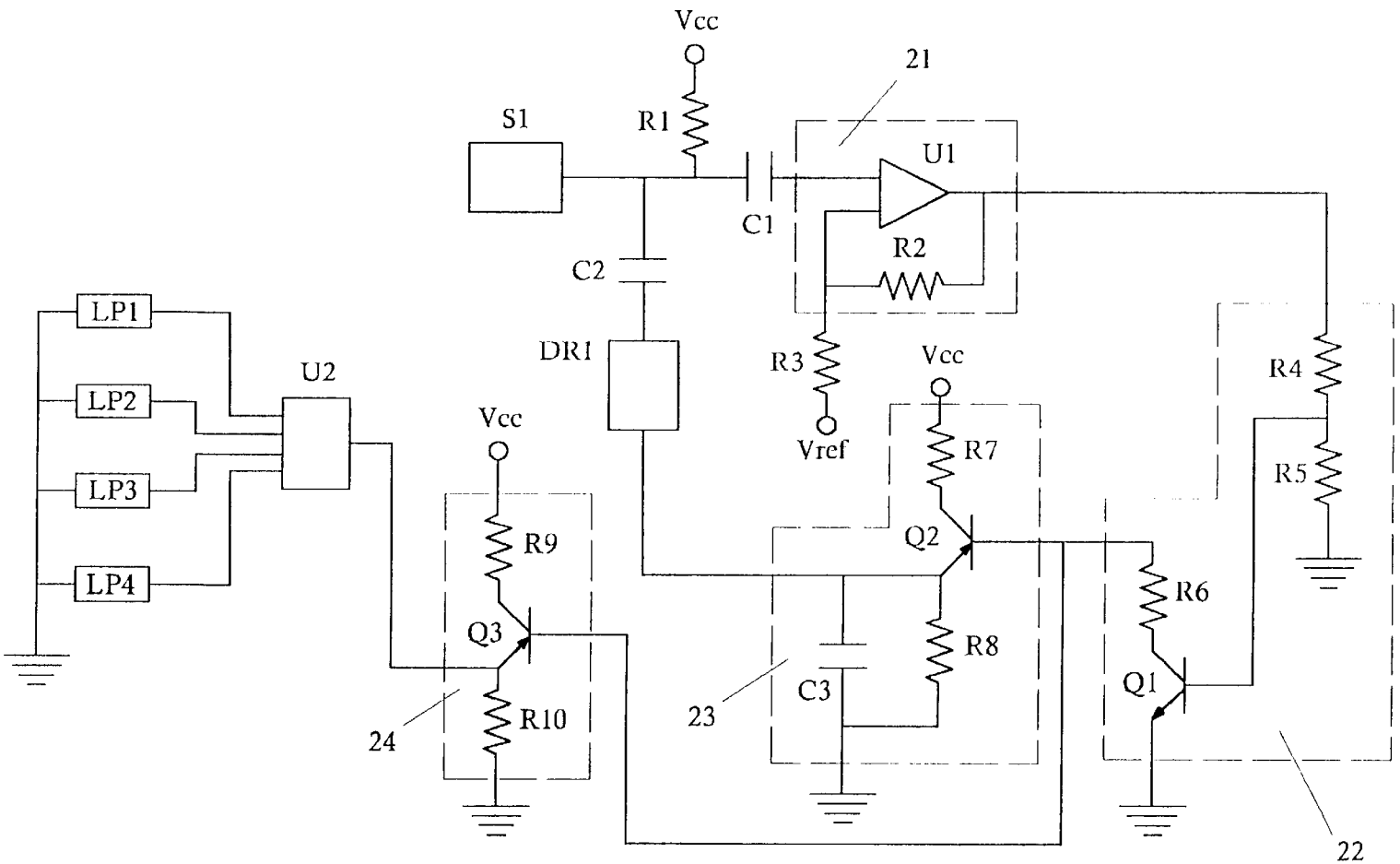
FIG. 4 is a circuit diagram of an embodiment of the present invention.

FIG. 2 shows a schematic drawing of the rotating disk of the present invention, and FIG. 3 shows is a block diagram of the circuit of the present invention. It's apparent from FIG. 4 that the present invention includes a rotating disk 1 and a drive circuit 2. The rotating disk 1 turns on a hinge 11. A plurality of light fittings LP (e.g. bulbs or light-emitting diodes) are radially disposed in a row on the displaying surface of the rotating disk 1. A sensor S1 and an eccentric switch (not shown) are arranged adjacent to the circumference. The drive circuit 2 fitted to the rotating disk 1 consists of an attenuator DR1 secured to the sensor S1, an amplifying circuit 21, a peak detecting circuit 22, a DC amplifying and stabilizing circuit 23, a peak waveform reorganizing circuit 24 and a microprocessor U2 connected to each of the light fittings LP. The amplifying circuit 21 includes an amplifier U1 and a resistance R2. The input end of the amplifier U1 is secured to the sensor S1 and the attenuator DR1. The input end of the peak detecting circuit 22 is connected to the output end of the amplifying circuit 21 while the output end thereof is connected to the DC amplifying and stabilizing circuit 23 and the peak waveform reorganizing circuit 24. The DC amplifying and stabilizing circuit 23 consists of resistances R7, R8, transistor Q2 and capacitance C3. The output end thereof is connected to the attenuator DR1. The peak waveform reorganizing circuit 24 consists of resistances R9, R10 and a transistor Q3. The output end thereof is connected to the microprocessor U2.

The operation of the aforementioned components is performed as follows:

When the rotational speed of the rotating disk 1 is up to the preset value, the eccentric switch works to create a closed circuit for activating the drive circuit 2. The attenuator DR1 begins to receive the surroundings signals detected by the sensor S1. The signals will be attenuated in order to prevent the distortion because of input of too great signals. Thereafter, the attenuated surroundings signals will be amplified by the amplifying circuit 21 up to the optimal state while the respective peak signals of the surroundings signal waveform is obtained by the peak detecting circuit 22. Then, the peak signals are respectively fed into the DC amplifying and stabilizing circuit 23 and the peak waveform reorganizing circuit 24. The signals filtered and amplified by the DC amplifying and stabilizing circuit 23 are fed to the attenuator DR1. The changed strength of peak signals is detected by the peak detecting circuit 22 in order to control the attenuation of the attenuator DR1. Peak linear signals inputted are converted into digital signals by the peak waveform reorganizing circuit 24 for deciding the rotational cycle of the rotating disk 1. Thereafter, the digital signals standing for rotational cycle is fed into the microprocessor U2 which takes a desired showing figure from the memory and the figure data are converted into signal data of time delay in lighting up each of the light fittings LP1~LP4, etc. at different time points (different positions of the rotating disk 1 in rotation). By means of the persistence of vision, the displaying surface of the rotating disk will create different preset complicate figures or characters.

The rotational cycle of the rotating disk 1 is effectively obtainable by the above-mentioned structure so that the lighting delay time point of each of the light fittings LP is accurately decided without consideration of the different rotational speed or instability of the rotating disk 1. Accordingly, the preset figures and characters can be shown without problem.

Figure 5:
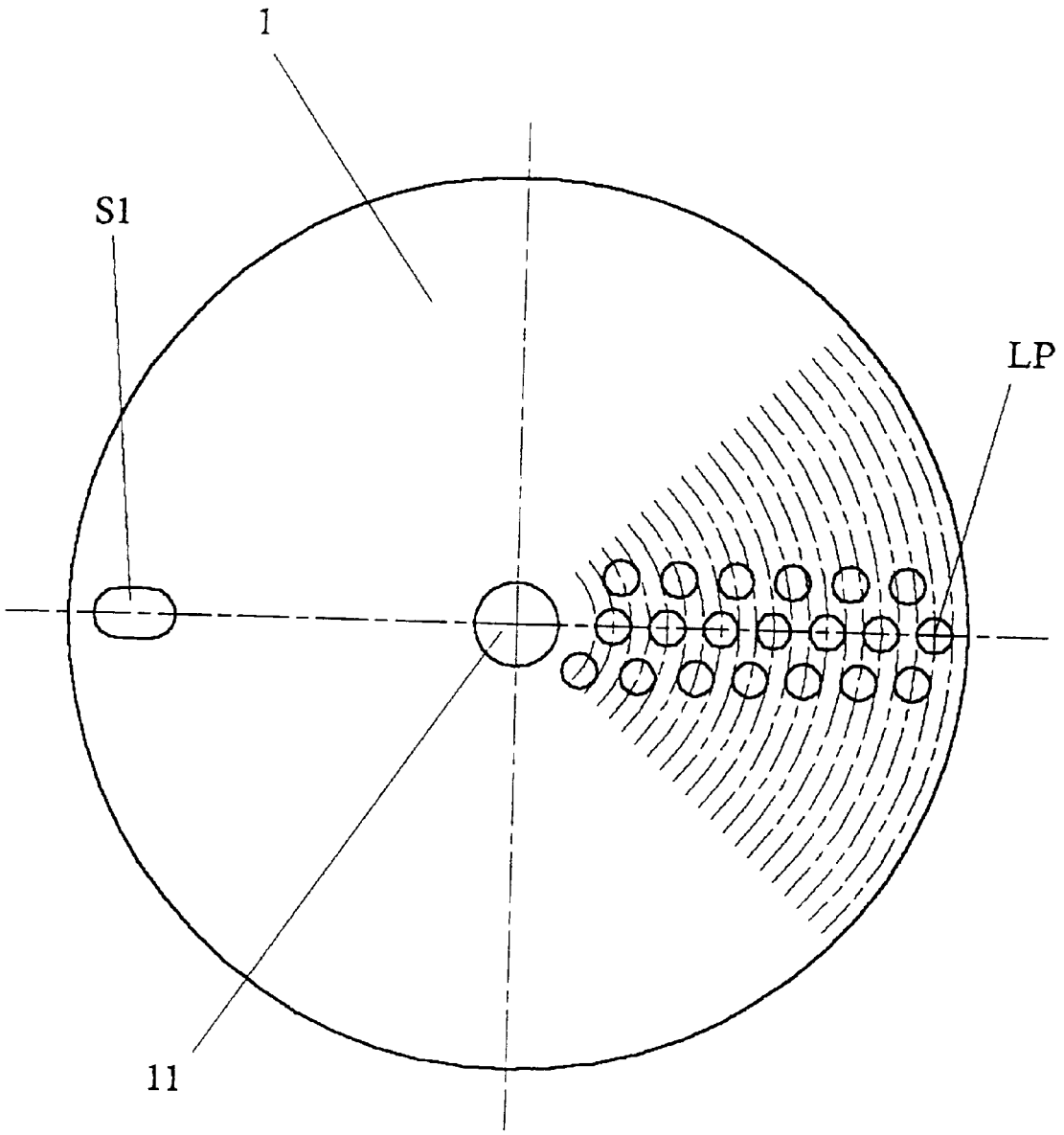
FIG. 5 is a schematic drawing of another embodiment of the rotating disk of the present invention.

FIG. 5 shows a schematic drawing of another embodiment of the rotating disk of the present invention. The light fittings LP can be distributed in several rows on the displaying surface of the rotating disk 1. The clearance between the light fittings LP and the hinge 11 can be different so that a denser scanning route of the light fittings LP on the displaying surface of the rotating disk 1 is created for a clearer displaying effect. The aforementioned sensor S1 can be constructed as spectrum sensor of long and short waves, metal sensor, magnetic field sensor, mechanical contact sensor and sound sensor.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A method for showing special characters or figures on a rotating disk at least comprising:

a first step: to detect the surroundings for obtaining repetitive surroundings signals as a sensor rotating along with said rotating disk detects different surroundings signals at different positions of the circumference while the sensor continues to turn so that the repetitive surroundings signals are obtained;

a second step: to decide the signal cycle being used to obtain a reference point of the repetitive surroundings signals for accurately deciding the cycle of the surroundings signals;

a third step: to get a desired figure from the memory in a random or preset way;

a fourth step: to convert the figure data into time delay data producing data of the required lighting duration and interval for each of said light fittings;

a fifth step: to light up the respective light fittings at different time in accordance with the acquired data enabling each of said light fittings to light up at different positions of said rotating disk at different time points while the displaying surface of the rotating disk will create different preset figures or characters by means of the persistence of vision of human eyes.

2. The method and apparatus of claim 1 wherein before performing said first step, it has to be judged firstly if the rotational speed of a rotating disk is enough to activate an eccentric switch and if said rotating disk reaches the basic rotational speed, and wherein If the answer is "no", a drive circuit doesn't work or stop, and if yes, said drive circuit is activated.

3. An apparatus for showing special characters or figures on a rotating disk at least comprising:

a rotating disk having a plurality of light fittings being radially disposed on the displaying surface thereof, a sensor being arranged thereon; and a drive circuit fitted to said rotating disk and including an attenuator secured to said sensor, an amplifying circuit, a peak detecting circuit, a DC amplifying and stabilizing circuit, a peak waveform reorganizing circuit and a microprocessor connected to each of the light fittings LP, said amplifying circuit being able to properly amplify the surroundings signals attenuated by an attenuator, the input end of said peak detecting circuit being connected to the output end of said amplifying circuit, said peak detecting circuit deciding each peak signal of said surroundings signal waveforms, the output end of said peak detecting circuit being connected to said DC amplifying and stabilizing circuit and said peak waveform reorganizing circuit, said peak signals given by said peak detecting circuit being abler to be filtered and amplified by said DC amplifying and stabilizing circuit, the output end of said DC amplifying and stabilizing circuit being connected to said attenuator while the output end of said peak waveform reorganizing circuit being connected to said microprocessor with memory saving preset data of figures and characters which is convertible into time delay signal data for lighting up said light fittings, the output end of said microprocessor being connected to said light fittings.

4. The apparatus and apparatus of claim 3 wherein said light fittings are distributed in several rows on the displaying surface of said rotating disk, and wherein the clearance between said light fittings and said hinge can be different so that a denser scanning route of said light fittings on the displaying surface of the rotating disk is created for a clearer displaying effect.

5. The apparatus and apparatus of claim 3 wherein said light fittings are self-lighting light sources.

6. The apparatus and apparatus of claim 3 wherein said sensor is constructed as spectrum sensor of long and short waves, metal sensor, magnetic field sensor, mechanical contact sensor and sound sensor.

7. The apparatus and apparatus of claim 3 wherein an eccentric switch is disposed on said rotating disk for deciding if said rotating disk is in a rotational status and if it reaches the minimum rotational speed.

* * * * *